US008111128B2

(12) United States Patent
Grudin et al.

(10) Patent No.: US 8,111,128 B2
(45) Date of Patent: Feb. 7, 2012

(54) MULTI-STRUCTURE THERMALLY TRIMMABLE RESISTORS

(75) Inventors: Oleg Grudin, Montreal (CA); Salman Saed, Verdun (CA); Tommy Tsang, Verdun (CA); Bowei Zhang, Brossard (CA); Leslie M. Landsberger, Montreal (CA); L. Richard Williston, Dunvegan (CA)

(73) Assignee: Sensortechnics GmbH, Puchheim (DE)

( * ) Notice: Subject to any disclaimer, the term of this patent is extended or adjusted under 35 U.S.C. 154(b) by 245 days.

(21) Appl. No.: 12/524,516

(22) PCT Filed: Feb. 6, 2008

(86) PCT No.: PCT/CA2008/000228

§ 371 (c)(1),
(2), (4) Date: Dec. 4, 2009

(87) PCT Pub. No.: WO2008/095290

PCT Pub. Date: Aug. 14, 2008

(65) Prior Publication Data

US 2010/0073121 A1 Mar. 25, 2010

Related U.S. Application Data

(60) Provisional application No. 60/899,648, filed on Feb. 6, 2007.

(51) Int. Cl.
*H01C 3/04* (2006.01)

(52) U.S. Cl. ..... 338/25; 338/195; 29/610.1; 29/620; 438/382

(58) Field of Classification Search ..... 338/195, 338/48, 320, 8, 333, 334, 25; 29/610.1, 620, 29/825, 829; 438/382, 385
See application file for complete search history.

(56) References Cited

U.S. PATENT DOCUMENTS

| | | | | |
|---|---|---|---|---|
| 5,466,484 | A | 11/1995 | Spraggins et al. | |
| 5,557,252 | A * | 9/1996 | Ariyoshi | 338/195 |
| 5,635,893 | A | 6/1997 | Spraggins et al. | |
| 5,679,275 | A * | 10/1997 | Spraggins et al. | 219/505 |
| 6,306,718 | B1 * | 10/2001 | Singh et al. | 438/382 |
| 7,119,656 | B2 | 10/2006 | Landsberger et al. | |
| 2004/0239477 | A1 * | 12/2004 | Landsberger et al. | 338/195 |
| 2006/0049912 | A1 * | 3/2006 | Grudin et al. | 338/195 |

OTHER PUBLICATIONS

International Search Report of the International Application No. PCT/CA2008/000228 dated May 20, 2008.

* cited by examiner

*Primary Examiner* — Kyung Lee
(74) *Attorney, Agent, or Firm* — Norton Rose OR, LLP

(57) ABSTRACT

A method for arranging a plurality of thermally isolated microstructures over at least one cavity, each of the microstructures housing at least part of a thermally-trimmable resistor, the thermally-trimmable resistor having at least a functional resistor, the method comprising: providing pairs of facing microstructures; grouping together sets of pairs of facing microstructures, each of the sets having at least one pair of facing microstructures; and arranging microstructures within a given set to have each microstructure exposed to heat from a same number of facing, side, and diagonal neighbors of microstructures from a same resistor.

22 Claims, 4 Drawing Sheets

MULTI-STRUCTURE THERMALLY TRIMMABLE RESISTORS

CROSS-REFERENCE TO RELATED APPLICATIONS

This application claims priority of U.S. Provisional Patent Application bearing Ser. No. 60/899,648 filed on Feb. 6, 2007 and entitled "Multi-Structure Thermally Trimmable Resistors".

TECHNICAL FIELD

The present application relates to the field of thermally-trimmable resistors in thermally isolated microstructures, and more specifically, to the layout of multiple microstructures housing the thermally-trimmable resistors on a single substrate.

BACKGROUND OF THE INVENTION

Prior art on thermally-trimmable resistors addresses trimming of such resistors housed in thermally-isolated microstructures. The microstructures offer substantial thermal isolation, allowing the microstructure to be raised to a high temperature using a minimal amount of power, while the temperature of the surrounding chip remains at a low temperature. Typical thermal isolation for cantilevers or membranes used in thermally-trimmable resistors is tens of degrees Kelvin of temperature rise per mW dissipated in the microstructure. For example if a microstructure has thermal isolation 50K/mW, then 20 mW dissipated in a heater-resistor in that microstructure, would raise the local on-microstructure temperature by 1000° C., which would result in thermal trimming of a functional resistor also housed in that same microstructure. Note that the heater-resistor may or may not be the same resistor as the functional thermally-trimmable resistor, and may or may not be made of the same materials as the functional thermally-trimmable resistor.

In many cases of practical manufacture of thermally-trimmable resistors, it may be advantageous to use more than one microstructure to house a single functional resistor having a specific target resistance value. For example, one may want to use one or more cantilever-shaped microstructure(s) of a particular standard size, to create thermally-trimmable functional resistors having different resistance values. For example, in such a case the cantilever size may be restricted due to limitations in the manufacturing technology (e.g. stress in the films, time needed for the microstructure release etch, mechanical robustness of the microstructure as a function of its size, and/or a fixed range of sheet resistance of the resistor film material). Thus, one may want to electrically connect the functional resistance traces from more than one cantilever, in series or parallel, and treat the resulting multiplicity as one device, thermally-trimming them all simultaneously with common trimming signals applied to the heater-resistors of each cantilever.

In some typical cases of thermal trimming, the heater-resistors are also thermally-trimmable, and in some cases are subject to failure (open-circuit), when subjected to high power and resulting high temperatures. Note that in cases where the heater-resistor and functional resistor are not the same, the temperature within the functional resistor is always somewhat less than the temperature within the heater-resistor, because the heater resistor is the source of the heat. Device failure can be brought about by excessive temperature and typically the trimming is limited by failure in the heater-resistor. For example in a single cantilever-shaped microstructure, where a separate heater-resistor and functional resistor are both polysilicon thin films, the trim-down range of the functional-resistor may be greater than 40%, and is limited beyond this point by open-circuiting of the heater-resistor.

Typically, the "trim range" or "trim-down range" refers to the specified maximum induced resistance change downwards (decreasing the resistance from its as-manufactured value) at the point where trimming ceases, usually as a result of failure of the heater-resistor (or aggregate heater, in the case where more than one microstructure is used). In many cases, due to the connectivity of the heater-resistors in an aggregate circuit, when one of the heaters fails (becomes open-circuited), it may disable (for a variety of reasons) any further heating (signaling the end of trimming). Barring severe manufacturing defects affecting a heater in a specific microstructure, the first heater-resistor to fail is typically in the "hottest" microstructure. Under normal operation, the hottest microstructure should also contain the functional resistance portion trimmed furthest down, meaning that all other microstructures have not reached their full trim-down potential. In effect, the hottest microstructure limits the overall adjustment range of the aggregate thermally-trimmable resistor.

In the case of a multi-microstructure or multi-cantilever resistor, if all of the microstructures/cantilevers were identically-shaped, with identical thermal isolation, and if all of the heater-resistors had identical resistance, then ideally all of the functional resistance traces could experience the same temperatures over time, and trim identically in unison. However, in practice, even if all of the materials and shapes and resistances were initially identical (initially, before any trim-heating signals are applied), if the micro-structures are positioned near each other in a silicon chip, the heat from trim-heating signals will be shared, to a non-zero extent, causing spatial non-uniformities in temperature, and causing unequal temperatures experienced by the (otherwise-identical) microstructures.

Typically, deep trim-downs require the highest trimming temperatures, and one may not raise the heater-temperatures indefinitely—eventually, when higher and higher temperatures are reached, the heater-resistor is likely to eventually fail, giving an open-circuit. Therefore, certain microstructures are likely to be closer to failure, and their corresponding functional resistor traces are likely to be trimmed down further, than their neighboring microstructures.

With such non-uniformities in temperature, each microstructure may experience a different trimming temperature, and thus different trimming behavior.

SUMMARY OF THE INVENTION

Non-uniformities in temperature and in trimming behavior are likely to occur in an array of microstructures where the position of any individual microstructure is not symmetric with respect to its neighbors in a closely-spaced group, or in other words, where the position of any individual microstructure with respect to its neighbors in a closely-spaced group is not equivalent to the position of the other microstructures with respect to neighbors within the same group.

Therefore, in any instance where the microstructures are close enough to each other that the heat is shared (meaning that the heat dissipated in each microstructure raises the temperature in neighboring microstructures), the principles described below herein of microstructure positioning should be applied. By using the arrangements suggested here, we intend to avoid "hot-microstructures" and to minimize temperature differences between the microstructures composing a functional thermally-trimmable resistor. While it is natural that within a given single microstructure there may be significant spatial temperature variations, the intent is that each microstructure have a maximum temperature and a spatial temperature profile as close as possible to those of the other microstructures which are part of the same functional thermally-trimmable resistor. In general, we intend to avoid and minimize differences and asymmetries in heating between microstructures, (asymmetries beyond those caused by random or unavoidable process-induced non-uniformities).

If it is impossible to avoid having significant temperature differences between the microstructures in a given resistor, then a small number (fraction) of "cold-microstructures", (among a larger fraction of hotter microstructures whose temperatures are relatively closer together), will give a better trimming range than a small number (fraction) of "hot-microstructures", among a larger fraction of colder microstructures whose temperatures are relatively closer together. This is because in the case where a small fraction of the microstructures are "cold", the trim range will benefit from the larger number of hotter microstructures. In the case where a small fraction of the microstructures are "hot", the rest of the (colder) microstructures will lose substantial trim range since they don't reach the higher temperatures required for deep trim-downs before the heaters begin to fail.

The principles of hot-microstructure avoidance are mostly independent of the method of thermal isolation and the shapes of the microstructures but can be used in combination with various thermal isolation techniques and shapes/sizes of microstructures. As long as there is some efficiency or advantage to be gained by positioning the microstructures in close proximity to each other (as opposed to just spreading them randomly around the surface of the substrate), and as long as the microstructures each have enough thermal isolation from the surrounding heat-sinks that those closely-proximal microstructures can share each other's heat, then the principles of symmetry apply in order to make that heat-sharing reciprocal (each shares the same heating from its neighbors).

In accordance with a first broad aspect of the present invention, there is provided a method for arranging a plurality of thermally isolated microstructures over at least one cavity, each of the microstructures housing at least part of a thermally-trimmable resistor, the thermally-trimmable resistor having at least a functional resistor, the method comprising: providing pairs of facing microstructures; grouping together sets of pairs of facing microstructures, each of the sets having at least one pair of facing microstructures; and arranging microstructures within a given set to have each microstructure exposed to heat from a same number of facing, side, and diagonal neighbors of microstructures from a same resistor.

In accordance with a second broad aspect of the present invention, there is provided a method for arranging a plurality of thermally isolated microstructures over at least one cavity, each of the microstructures housing at least part of a thermally-trimmable resistor, the thermally-trimmable resistor having at least a functional resistor, the method comprising: providing pairs of facing microstructures; grouping together sets of pairs of facing microstructures, each of the sets having at least three pairs of facing microstructures; and arranging microstructures within a given set to minimize a temperature difference between microstructures for a same resistor, the temperature difference caused by a spatial relationship and a number of neighboring microstructures for a same resistor from whom heat is shared, a diagonal neighbor providing less heat than a facing or side neighbor.

In accordance with a third broad aspect of the present invention, there is provided a method for arranging a plurality of thermally isolated microstructures over at least one cavity, each of the microstructures housing at least part of a thermally-trimmable resistor, the method comprising: providing pairs of facing microstructures; grouping together sets of pairs of facing microstructures, each of the sets having at least three pairs of facing microstructures; and arranging microstructures within a given set for a same resistor to have a smaller number of microstructures exposed to less heat than microstructures exposed to more heat, a level of heat being a result of a spatial relationship and a number of neighboring microstructures for a same resistor from whom heat is shared, a diagonal neighbor providing less heat than a facing or side neighbor.

In accordance with a fourth broad aspect of the present invention, there is provided a substrate comprising a plurality of thermally isolated microstructures each housing at least part of a thermally-trimmable resistor, the thermally-trimmable resistor having at least a functional resistor, the thermally isolated microstructures provided in pairs of facing microstructures, the pairs grouped together into sets, each of the sets having at least one pair of facing microstructures, and each set being arranged for heat-sharing, each microstructure in a given set exposed to heat from a same number of facing, side, and diagonal neighbors of microstructures from a same resistor.

In accordance with a fifth broad aspect of the present invention, there is provided a substrate comprising a plurality of thermally isolated microstructures each housing at least part of a thermally-trimmable resistor, the thermally-trimmable resistor having at least a functional resistor, the thermally isolated microstructures being arranged in sets of pairs of facing microstructures for heat-sharing, the microstructures in a given set arranged to minimize a temperature difference between microstructures for a same resistor, the temperature difference caused by a spatial relationship and a number of neighboring microstructures for a same resistor from whom heat is shared, a diagonal neighbor providing less heat than a facing or side neighbor, each set having at least three pairs of facing microstructures.

In accordance with a sixth broad aspect of the present invention, there is provided a substrate comprising a plurality of thermally isolated microstructures each housing at least part of a thermally-trimmable resistor, the thermally-trimmable resistor having at least a functional resistor, the thermally isolated microstructures being arranged in sets of pairs of facing microstructures for heat-sharing, the microstructures arranged within a given set to have a smaller number of microstructures exposed to less heat than microstructures exposed to more heat for a same resistor, a level of heat being a result of a spatial relationship and a number of neighboring microstructures for a same resistor from whom heat is shared, a diagonal neighbor providing less heat than a facing or side neighbor.

In this specification, the term "neighbor" is intended to mean a microstructure that is beside, in front, or diagonal to another microstructure. The term "hot microstructure" is intended to mean a microstructure receiving more heat from neighboring microstructures than other surrounding microstructures. The term "cold microstructure" is intended to mean a microstructure receiving less heat from neighboring microstructures than other surrounding microstructures. Note that the heater-resistor may or may not be the same resistor as the thermally-trimmable resistor, and may or may not be made of the same materials as the thermally-trimmable resistor.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1A:
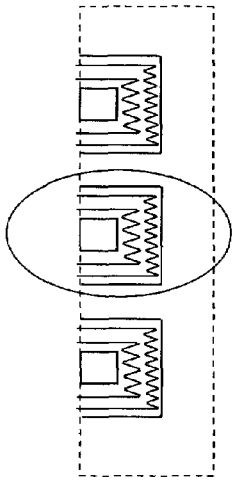
FIG. 1*a* is a single file three microstructures illustrating the "hot-microstructure" effect.

Consider FIG. 1*a*, depicting an array of 3 cantilever-shaped microstructures, single-file, all on the same side of a cavity, with all heaters being trim-pulsed simultaneously. In the figures, showing cantilever-shaped microstructures, each of the microstructures shows two symbols each representing an electrical resistance, a heater-resistance portion and a functional resistance portion, which are electrically (but not thermally) isolated from each other. Note, these resistance symbols are not intended to represent actual shapes of resistance lines in the microstructures, rather only the presence of resistance elements. Each resistance portion may or may not be a part of a larger resistor consisting of more than one microstructure—with the functional resistance portion being a part of a larger functional resistor, and with the heater resistance portion being a part of a larger heater resistor. Alternatively, certain embodiments may include only a functional resistance portion and no heater resistance portion. In this case, heating is done via the functional resistance portion.

If the three heaters in FIG. 1*a* each receive identical heating power (say, $P_o/3$), such that the total power dissipated in the entire group of 3 microstructures is $P_o$), the heat dissipated in the 3 heaters will be partially shared. Each microstructure will be heated by the power dissipated within itself, and will to a lesser extent also experience temperature rise due to power dissipated in its neighboring microstructure(s). Thus, if the spacing between microstructures is small enough, the steady-state temperature of each microstructure in the group of 3, will be greater than that of a single isolated microstructure receiving power $P_o/3$. Since the central microstructure has two such neighbors, its temperature will be higher than the other two microstructures (who each only have one such neighbor). Thus this configuration gives spatial temperature differences among the 3 microstructures, with the microstructure in the center experiencing the highest temperature of the three. Note: this may be further exacerbated by changes in resistance over temperature (TCR effects) and/or dynamic trimming effects of the heater-resistor, which can further increase the power dissipated in the "hot" microstructure, potentially further modifying the temperature differences among the microstructures.

Figure 1B:
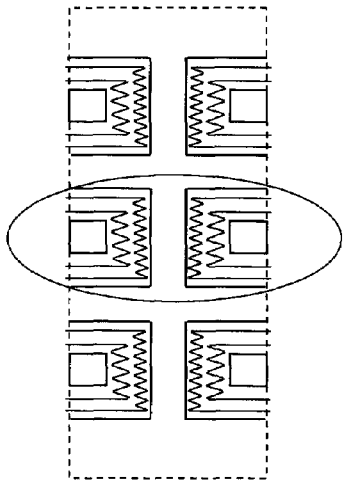
FIG. 1*b* is a set of three pairs of facing microstructures illustrating the "hot-microstructure" effect.

The same type of "hot-microstructure" difficulty applies to FIG. 1*b* (6 cantilevers, arranged in pairs on opposite sides of a single cavity). The pair of cantilevers facing each other in the center will experience the highest temperatures of the three pairs, since they each have one facing neighbor, two side-neighbors and two diagonal neighbors, and are receiving heat from their neighbors on three out of four sides, while the four corner cantilevers each have only one facing neighbor, one side neighbor, and one diagonal neighbor, and are receiving heat from their neighbors only on two out of four sides.

In general, where there are two rows of microstructures arranged on opposite sides of a rectangular cavity, the most significant heat sharing must be a function of proximity and is dominated by contributions from facing or side-neighbors. Both of these will cause more heat sharing than a diagonal neighbor. Whether it is facing or side neighbors which contribute the most to temperature rise depends on the distance-to-neighbor in each of the two directions (facing vs side).

Figure 1C:
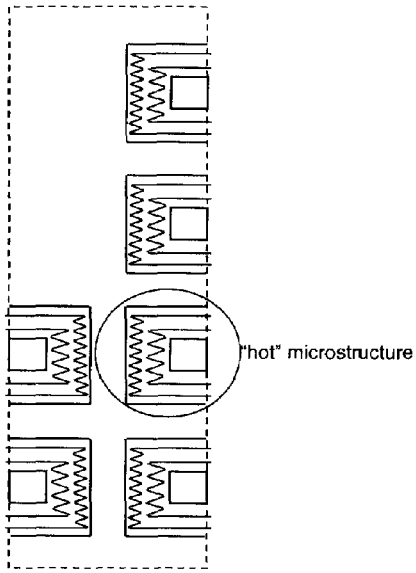
FIG. 1*c* is a non-symmetric set of six microstructures illustrating the "hot-microstructure" effect.

FIG. 1*c* shows a non-symmetric array of six microstructures, which was also experimentally tested, and demonstrates a severe decrease in trim range. While a single cantilever had a trim-down range of greater than 40%, the group of cantilevers in FIG. 1*c* can be trimmed down by only ~25%, and the first heater to become open-circuited is always in the microstructure indicated (circled) in the figure—the one which achieves the highest temperature, since it alone has the highest number of immediate (facing or side) neighbors of any microstructure in the group, as well as a diagonal neighbor.

As another example, consider an array of 10 cantilever-shaped microstructures arranged in two rows of 5, opposite each other above a single bulk-micro-machined cavity in a silicon chip (see FIG. 1*d*), with all heaters being trim-pulsed simultaneously. If these 10 heaters each receive identical heating power (say, $P_o/10$, such that the total power dissipated in the entire group of 10 microstructures is $P_o$), the heat dissipated in the 10 heaters will be partially shared, and the average temperature in the 10 microstructures will be greater than it would be if a single isolated microstructure received $P_o/10$. Furthermore, the temperature will vary spatially among the 10 microstructures. The four individual microstructures on the four corners will experience the lowest temperatures (of the 10 microstructures), and the two microstructures facing each other at the center of the array will experience the highest temperatures (of the 10 microstructures).

Figure 1D:
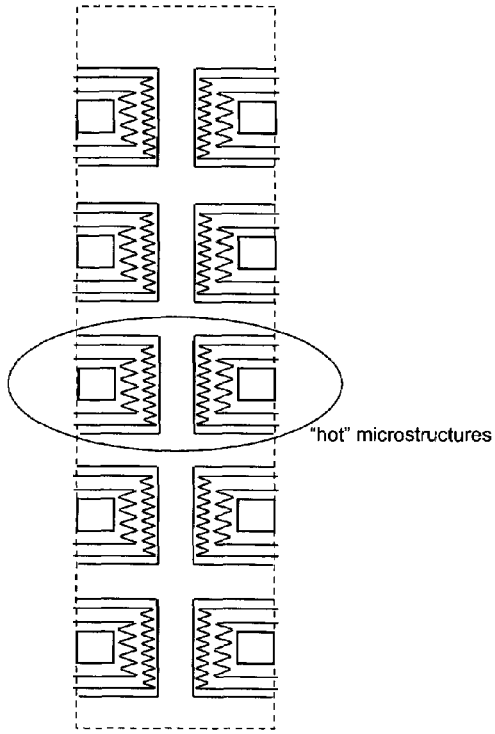
FIG. 1*d* is a set of five pairs of facing microstructures illustrating the "hot-microstructure" effect.

Table 1 shows the results for trim-down percentages of individual microstructures in the 10-microstructure array shown in FIG. 1*d*. The microstructures (and their embedded heater-resistors and functional resistors) were all designed to be identical, and common trim-heating electrical pulses were applied to all 10 heaters simultaneously. As shown in Table 1, six different trim-downs were applied, (labeled tr#1 to tr#6), to increasing trim-down amounts, as measured by the overall series resistance of the 10 functional resistors. Clearly the two central microstructures trim down the most (indicating that they have reached the highest temperatures), while the four corner microstructures have trimmed down the least.

Figure 2A:
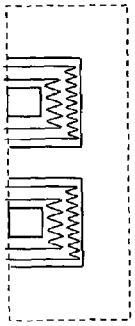
FIGS. 2*a* to 2*c* are examples of microstructure designs that do not experience the "hot-microstructure" effect.
Figure 2B:
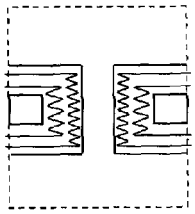

A single microstructure is by its nature not prone to such "hot-microstructure" effects. In a pair of identically-designed microstructures, positioned side-by-side (as in FIG. 2*a*), each of the two microstructures experiences the same effect from the sharing of heat from its neighbor, provided the spacing to the cavity above and below is not asymmetric with respect to the microstructures—thus is not prone to "hot-microstructure" effects. Similarly, in a pair of identically-designed microstructures, positioned facing each other (as in FIG. 2*b*), each of the two microstructures experiences the same effect from the sharing of heat from its neighbor, provided the spacing to the cavity above and below is not asymmetric with respect to the microstructures—thus is not prone to "hot-microstructure" effects.

Figure 2C:
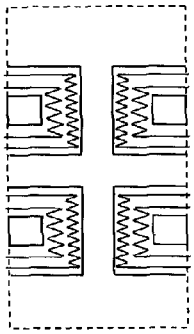

In a group of four identically-designed microstructures, positioned in two groups of two, facing each other (as in FIG. 2*c*), each of the four microstructures experiences the same effect from the sharing of heat from its neighbors, provided the spacing to the cavity above and below, is not asymmetric with respect to the microstructures—thus is not prone to "hot-microstructure" effects.

In cases where one wants to use only 3 microstructures to implement a specific target resistance value, it would be advantageous (from the point of view of avoiding "hot-microstructures") to position the 3 within a symmetric group of 4, and apply the trim-heating signals to all four heaters. In one embodiment, the fourth microstructure (a dummy) is identical to the others including that it has identical functional and heater resistors as the other microstructures, and has identical thermal conduction paths for heat to flow to and from it, to imitate the heat flow to and from the other three active microstructures, except that its functional resistor is not electrically connected as part of the overall functional resistor composed of the other three functional resistor segments. This may include dummy electrical lines, to imitate the heat conduction of the other three functional resistor segments, but which are electrically disconnected from those other three functional resistor segments.

Note that in a group of four microstructures, uniformly spaced in a row (similarly to FIG. 1*a*), the central microstructure(s) will be "hot microstructures" with respect to the two microstructures positioned at the ends of the row—(unless the spacing between the microstructures is large enough that the sharing of heat becomes negligible). The same problem applies to a group of 8 microstructures, in two rows facing each other (similarly to FIG. 1*b*)—the central four microstructures will be "hot" with respect to the microstructures positioned at the four corners of the array.

Figure 2D:
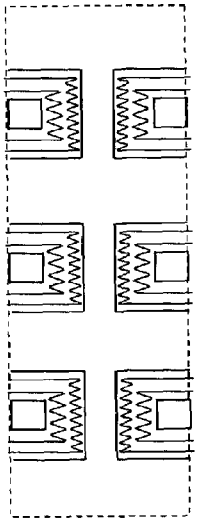
FIG. 2*d* shows three pairs of microstructures more widely spaced than in FIGS. 2*a* to 2*c*, in order to reduce and/or eliminate the "hot-microstructure" effect.
Figure 2E:
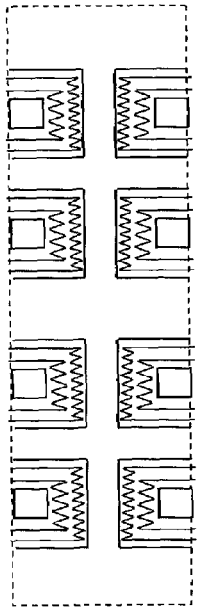
FIG. 2*e* is a layout using spacing for four pairs of facing microstructures to reduce and/or eliminate the "hot-microstructure" effect.
Figure 2F:
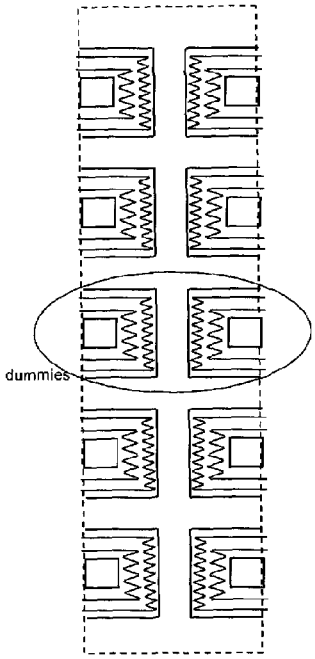
FIG. 2*f* is a layout using dummy microstructures for four pairs of facing microstructures to reduce and/or eliminate the "hot-microstructure" effect.
Figure 2G:
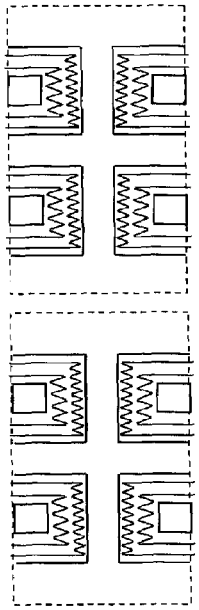
FIG. 2*g* is a layout using a heat absorbing baffle for four pairs of facing microstructures to reduce and/or eliminate the "hot-microstructure" effect.

If one must use more than four microstructures, then it is desirable to group them into sets of 2 or 4 such that heat-sharing from one set to the next is minimized, such as by increasing the spacing between the set (as shown in FIGS. 2*d*, 2*e*), or by inserting a heat-absorbing baffle between the sets (FIG. 2*g*), or by placing the sets of 2 or 4 microstructures in separate dedicated cavities. FIG. 2*d* shows three pairs (and three sets) of facing microstructures, spaced farther apart than in FIG. 1*b*, in order to reduce or eliminate the "hot microstructure" effect in the middle pair of microstructures. FIG. 2*e* is an arrangement using extra separation between the two sets of four microstructures, in order to reduce or eliminate temperature differences between the four microstructures in the middle vs. the four microstructures on the corners of the cavity. FIG. 2*f* is an arrangement using "dummy" microstructures in order to reduce or eliminate temperature differences between the four microstructures in the middle vs. the four microstructures on the corners of the cavity. Note that in FIG. 2*f*, the dummy microstructures are not heated while heating signals are applied to any of the other heaters. These dummy microstructures in FIG. 2*f* are shown as being identical to other microstructures, but can also be of arbitrary shape and size, as well as being composed of different materials. FIG. 2*g* is an arrangement using a heat-absorbing baffle between the two cavities (indicated by dashed lines), in order to reduce or eliminate temperature differences between the four microstructures in the middle of the figure vs. the four microstructures on the outer corners of the figure. The cases depicted in FIGS. 2*d*, 2*e*, 2*f*, 2*g* may also be seen as techniques to effectively separate a larger group of microstructures into sets of 4, intending to benefit from the symmetry inherent in groups of 4, as described in FIG. 2*c*.

Indeed, Table 2 shows the results of experimental trim-downs (similar to those described above for Table 1), for the structure depicted in FIG. 2*f*, where the two central microstructures are "dummies"—identical to the others except that their heaters do not receive trim-heating signals, and their functional resistor is not connected (not part of the measured functional resistance consisting of the series connection of the other 8 resistors). The trim-down amounts of the 8 functional resistors embedded in each of the 8 microstructures are much more uniform than was found in Table 1.

One may also make changes to the layout and/or materials in the microstructures, to increase the thermal isolation of the colder microstructures and/or decrease the thermal isolation of the hotter microstructures, such that the actual temperature differences are minimized. The thermal isolation could be relatively increased by a number of means, for example reducing the width or thickness of heat-conducting materials connecting the microstructure to any nearby heat sink(s). By increasing the thermal isolation of a specific microstructure in this way (by changing the heat-conduction paths through the solid connections to the microstructure), one increases the temperature reached by that specific microstructure (for a given power dissipated within that microstructure), thus increasing the net heat flow from that microstructure to other neighboring microstructures. Similarly, if one decreases the thermal isolation of a specific microstructure, one reduces the temperature reached by that specific microstructure (for a given power dissipated within that microstructure), thus decreasing the net heat flow from that microstructure to other neighboring microstructures (increasing net heat from to that microstructure from other neighboring microstructures).

Overall thermal isolation is affected by several physical phenomena related to the various "paths" by which heat flows away from the microstructure. These include heat conduction through the solid arms of the microstructure out to the main substrate, heat conduction into the gas in the cavity, and heat radiation away from the microstructure. In the embodiments described herein, assuming that the cavity above and below the microstructure are far enough away, the major heat conduction path is out through the microstructure arms. It is mostly affected by the width and thickness of the polysilicon and metal traces that go out the arms onto the substrate, since these are the most-heat-conductive materials in the arms. So increasing thermal isolation means reducing heat flow out through the arms with the goal of raising the temperature of the microstructure, for a given amount of power dissipated within it. If the temperature is raised, then it is expected that the neighboring microstructures will feel that temperature rise by heat flow from it. Note that the main mechanisms by which the neighboring microstructures are heated are radiation and conduction in the surrounding gas—and it is expected that these would not be changed by changing heat-conduction path out through the arms.

One may deliberately increase the amount of power dissipated in the colder microstructures, such as by reducing their heat-resistance, or adding an auxiliary heat source. One may also deliberately decrease the amount of power dissipated in the hotter microstructures of a given functional resistor. This can be accomplished by, for example, partitioning the heater-resistor in a hotter microstructure into two portions, one portion dissipating power elsewhere (away from the set of microstructures), leaving a smaller percentage of the power being dissipated within the microstructure. One may also partition the heater-resistors within a given functional resistor, such that the two (or more) groups are not heated at the same time. This is done by connecting together the microstructure heaters of a subset of microstructures in a set so that they receive heating signals together, while the remainder of the microstructures in the same set do not receive the heating signals until another time, whereby the subsets are disconnected from each other so that one subset can be given heating signals without heating the other subset(s).

Figure 3A:
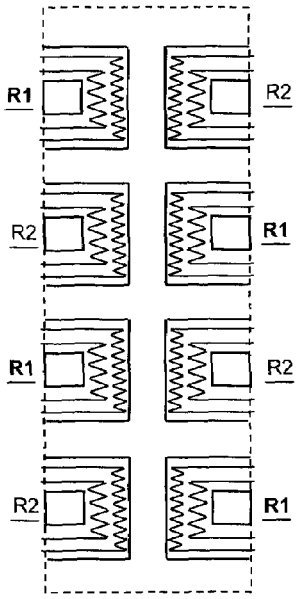
FIGS. 3*a* to 3*d* are arrangements with interleaved microstructures for 1:1 ratios of the number of microstructures per resistor, in order to reduce and/or eliminate the "hot-microstructure" effect.

The above analysis applies to avoiding "hot-microstructures" in a single thermally-trimmable resistor. Alternatively, in many cases of design of thermally-trimmable resistors, it is desired to include two or more functional thermally-trimmable resistors on a single chip. In this case, some advantages may be attained by co-arrangement of the microstructures. For example:

FIG. 3*a* shows a set of microstructures including two thermally-trimmable resistors in a single cavity, where R1 and R2 each are composed of 4 microstructures, alternating across the cavity such that when trimming signals are applied to the heaters of one of R1, R2 (not both simultaneously), heat sharing is minimized between the microstructures. In this case, the coldest microstructures have only one (diagonal) neighbor, while the hottest microstructures have two diagonal neighbors. The temperature difference between hottest and coldest may still exist, but relatively small (compared to, say the temperature differences in FIG. 1*b* or 1*d*). Table 3 shows the trim-down percentages for a configuration as shown in FIG. 3*a*—showing some non-uniformity, but far less than in Table 1.

Figure 3B:
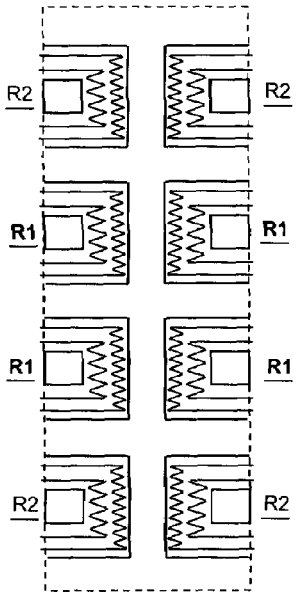

FIG. 3*b* shows an alternative configuration for a set of microstructures. Again two thermally-trimmable resistors are housed in a single cavity, where R1 and R2 are each composed of 4 microstructures. The four inner microstructures (R1) all have the same spatial relationships with their neighbors (within R1, which will all receive heat simultaneously), and the four outer microstructures (R2) all have the same spatial relationships with their neighbors within R2 (i.e. which comprises two pairs of facing microstructures, each pair being far from the other such that there is negligible heat-sharing from one pair to the other).

Figure 3C:
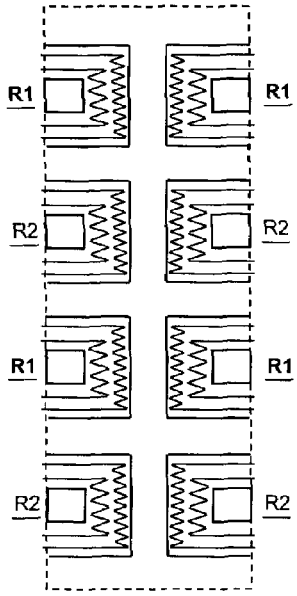

FIG. 3*c* again shows two thermally-trimmable resistors in a single cavity, but here they are arranged in alternating pairs for a same resistor, such that each resistor has an "outer" pair and an "inner" pair, separated from each other by a pair from the other resistor (which should be enough separation to avoid substantial heat sharing between the two pairs). Note, if more area is available, each pair can be placed in a separate cavity.

Figure 3D:
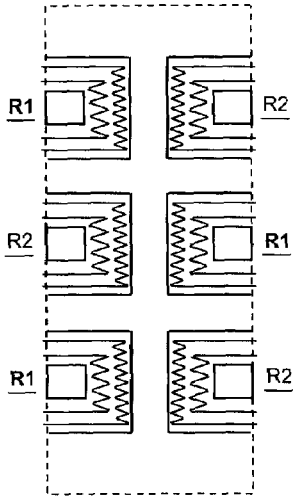

FIG. 3*d* shows a case similar to FIG. 3*a*, where R1 and R2 are each composed of 3 microstructures, alternating across the cavity such that within a given resistor there are only diagonal neighbors (no facing or direct side neighbors). Larger numbers of microstructures are also amenable to these principles, as will be understood by a person skilled in the art.

The above examples (FIGS. 3*a*-3*d*) are effective when one can implement the two functional resistance values R1, R2 in an equal number of microstructures, such as when the resistance ratio R1:R2 is relatively not too far from 1:1. Other challenges can arise when it is desired to implement two thermally-trimmable resistors having substantially different resistance values, while using same or very similar microstructures (each housing same or similar functional resistance values). In such cases, where it is desired to keep the number of microstructures in each resistor proportional to the resistance ratio, it may be difficult to alternate or interleave the microstructures. Whatever the reason for it being desirable to have specific non-1:1 ratios of the numbers of microstructures, the techniques below may be applied to minimize hot-microstructure degradation effects.

Figure 4A:
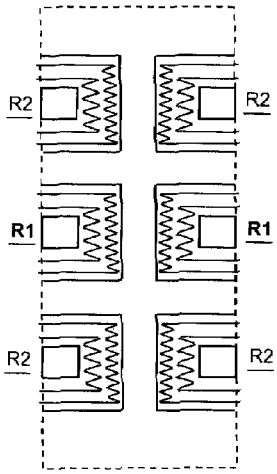
FIGS. 4*a* to 4*c* are arrangements with interleaved microstructures for specific non-1:1 ratios of the number of microstructures per resistor, in order to reduce or eliminate the "hot-microstructure" effect.

For example, a 1:2 ratio of microstructures in a given set can be implemented as shown in FIG. 4*a*, where in R2 the two pairs of facing microstructures are positioned symmetrically on the two ends of the cavity such that each microstructure has the same relationship to all of its neighbors within R2, and each of the two pairs of facing microstructures is relatively well separated from the other.

However, a 1:3 ratio in a given set becomes more problematic, since in a planar rectangular geometry, for R2 it is impossible to position three pairs of facing microstructures such that each microstructure has the same relationship to all of its neighbors, and since there is only one pair from R1 to interleave between two pairs from R2. In practice, adding a facing pair of dummy microstructures would accomplish the wide separation of the three pairs in R2, at the cost of larger area, as was done in FIG. 2*f*.

Also, in general, if area is available, the influence of neighbors can be reduced and temperature differences can be decreased by increasing the distance between microstructures, or by placing each pair (or group of 4) of microstructures in its own separate cavity.

Figure 4B:
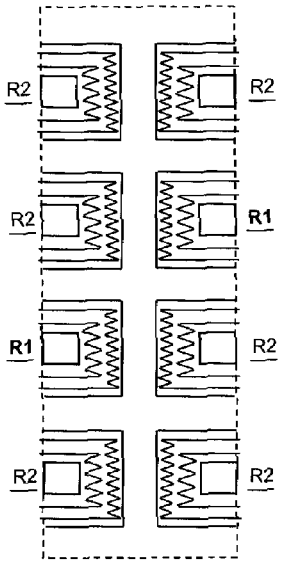

In the case where it is important to avoid the use of dummy microstructures (such as in the interests of area-efficiency), or other techniques for separation that involve increasing the area used, then FIG. 4*b* shows a possible arrangement. Since it is most interesting to avoid large differences in temperatures between the coldest and hottest microstructures, and since R1 does not have enough microstructures to inhabit all four corners, the presence of coldest microstructures cannot be avoided. Thus, one attempts to substantially reduce the temperature differences primarily by reducing the temperatures of the hottest microstructures in a given set. The arrangement shown in FIG. 4*b* accomplishes this, to a certain extent, because in R2 the three different configurations have not dramatically different neighbor arrangements. The top-right microstructure has one facing neighbor and one diagonal neighbor; the top-left microstructure has one facing neighbor and one side neighbor (likely hotter than the top-right microstructure, because a side neighbor delivers more heat than a diagonal neighbor); and the left-side second-from-top microstructure has one side neighbor and two diagonal neighbors (no facing neighbor). The difference between hottest and coldest is due only to the difference between a facing neighbor and two diagonal neighbors, or to the difference between a side neighbor and a diagonal neighbor, or to the difference between a facing neighbor vs a side neighbor and a diagonal neighbor.

Figure 4C:
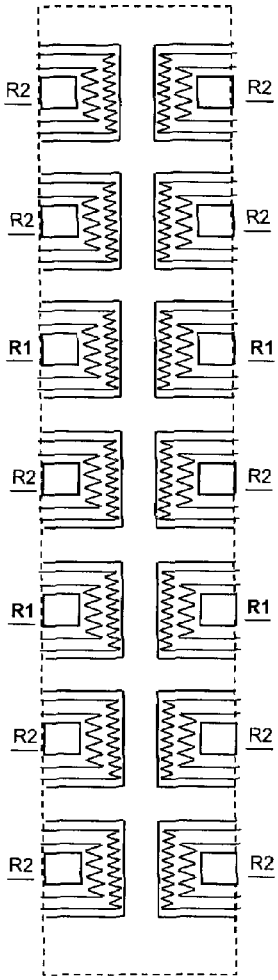

In another example, if the desired ratio of microstructures is 4:10 in a given set, there is again no way to use the R1 pairs to separate R2 into groups of 2 or 4. In such a case, as mentioned above, it is better to have a relatively small number of "cold" microstructures than a relatively small number of "hot" microstructures. Thus the arrangement depicted in FIG. 4*c* gives a suitable solution. Even though the pair of microstructures in the center will be "colder" than the groups of 4 microstructures, during thermal trimming of R2, the temperature-difference-induced trim range reduction will be low because only two microstructures are affected.

Increasing the number of microstructures beyond those described herein may have the benefit of averaging out the effects of hot microstructures. For example, if FIG. 1*d* is extended to more pairs of microstructures, e.g. 7 pairs, the central pair of microstructures is still likely to be the hottest, but likely not so much hotter than the pairs adjacent to the center, thus reducing the temperature differences and alleviating somewhat the "hot-microstructure" effect. However, such an increase in number of microstructures would require increased area, and thus may be counterproductive to certain principles of efficient analog electronics design. For the purpose of design where device area is not a constraint, or designs requiring higher power-carrying capability, it can be considered.

Note that the microstructures do not need to be shaped as cantilevers such as are depicted in the figures—many different shapes of microstructures are subject to the principles described herein.

The embodiments of the invention described above are intended to be exemplary only. The scope of the invention is therefore intended to be limited solely by the scope of the appended claims.

TABLE 1

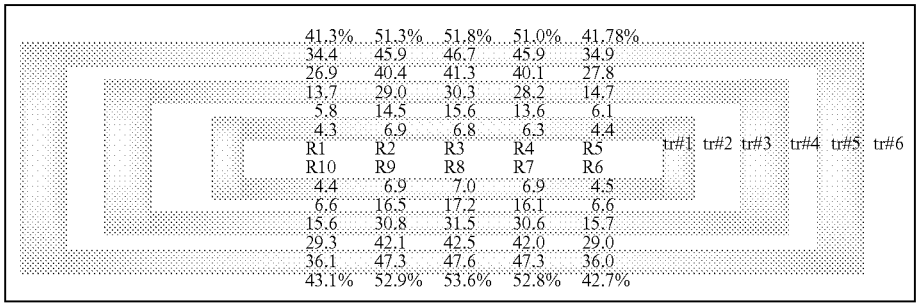

TABLE 2

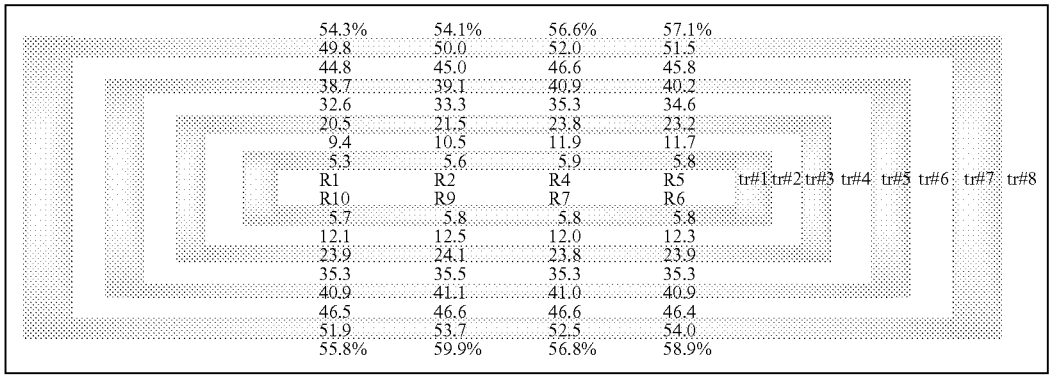

TABLE 3

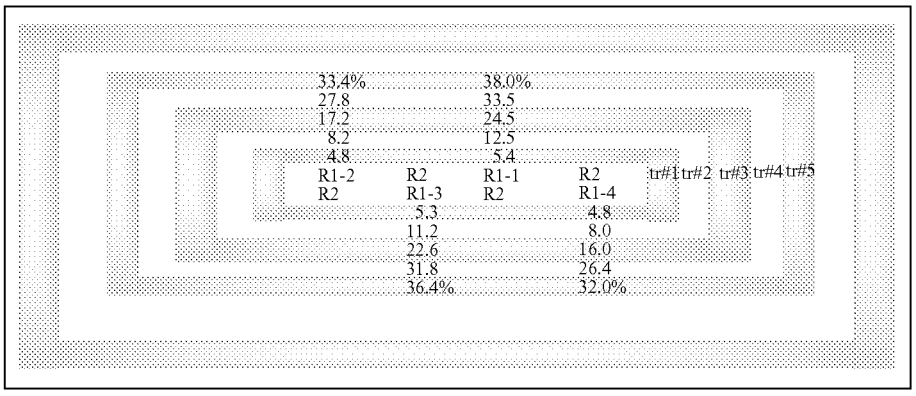

We claim:

1. A substrate comprising a plurality of thermally isolated microstructures each housing at least part of a thermally-trimmable resistor, said thermally-trimmable resistor having at least a functional resistor, said thermally isolated microstructures provided in pairs of facing microstructures, said pairs grouped together into sets, each of said sets having at least one pair of facing microstructures, and each set being arranged for heat-sharing, each microstructure in a given set exposed to heat from a same number of facing, side, and diagonal neighbors of microstructures from a same resistor during a trimming procedure.

2. A substrate as claimed in claim 1, wherein said sets are separated, separated sets having lower heat-sharing capabilities between sets than between microstructures of a same set.

3. A substrate as claimed in claim 2, wherein said separated sets comprise spacing between said sets to reduce a heat-sharing effect between microstructures of neighboring sets, whereby spacing between microstructures in a same set is smaller than spacing between sets.

4. A substrate as claimed in claim 2, wherein said separated sets comprise a pair of facing dummy microstructures between neighboring sets, said dummy microstructures not receiving trim-heating signals during trimming of said microstructures in said neighboring sets.

5. A substrate as claimed in claim 2, wherein said separated sets comprise a heat-absorbing baffle between neighboring sets.

6. A substrate as claimed in claim 2, wherein said separated sets comprise a separate dedicated cavity for each set.

7. A substrate as claimed in claim 1, wherein a given set comprises an additional microstructure, which is a dummy microstructure, when an odd number of microstructures is present, said dummy microstructure paired with one of said microstructures into a pair of facing microstructures, said dummy microstructure comprising a heater receiving trim-heating signals during trimming of said microstructures and a dummy functional resistor that is not electrically connected to said functional resistor of said microstructures.

8. A substrate as claimed in claim 1, wherein said pairs of facing microstructures are for a same resistor, and said sets comprise pairs of facing microstructures for a first resistor alternated with pairs of facing microstructures for a second resistor.

9. A substrate as claimed in claim 1, wherein said pairs of facing microstructures are for a same resistor, and said sets comprise sets of one pair of facing microstructures for a first resistor alternated with sets of two pairs of facing microstructures for a second resistor.

10. A substrate as claimed in claim 1, wherein said microstructures in a given set are contiguous and have substantially equal spacing between side neighbors and substantially equal spacing between front neighbors.

11. A substrate comprising a plurality of thermally isolated microstructures each housing at least part of a thermally-trimmable resistor, said thermally-trimmable resistor having at least a functional resistor, said thermally isolated microstructures being arranged in sets of pairs of facing microstructures for heat-sharing, said microstructures in a given set arranged to minimize a temperature difference between microstructures for a same resistor during a trimming procedure, said temperature difference caused by a spatial relationship and a number of neighboring microstructures for a same resistor from whom heat is shared, a diagonal neighbor providing less heat than a facing or side neighbor, each set having at least three pairs of facing microstructures.

12. A substrate as claimed in claim 11, wherein said sets comprise microstructures for a same resistor arranged to have some microstructures sharing heat from two diagonal neighbors and other microstructures sharing heat from a single diagonal neighbor, and wherein no heat is shared by a front or side neighbor.

13. A substrate as claimed in claim 11, wherein said sets comprise a smaller number of microstructures exposed to less heat from its neighbors compared to other microstructures in a given set, than microstructures exposed to more heat from its neighbors compared to other microstructures in the given set.

14. A substrate as claimed in claim 11, wherein said sets comprise an increased thermal isolation to microstructures in a set that are colder than other microstructures for a same resistor under equivalent thermal isolation conditions.

15. A substrate as claimed in claim 14, wherein said increased thermal isolation comprises a reduced width of heat-conducting materials connecting the colder microstructures to nearby heat sinks for a same resistor in a set.

16. A substrate as claimed in claim 11, wherein said sets comprise an auxiliary heat source to increase an amount of power dissipated in colder microstructures compared to hotter microstructures for a same resistor in a set.

17. A substrate as claimed in claim 11, wherein said sets comprise a heater-resistor partitioned into at least two portions for hotter microstructures for a same resistor in a given set, one of said at least two portions dissipating power away from said given set.

18. A substrate as claimed in claim 11, wherein said sets comprise a partitioned heater resistor for a same functional resistor that exposes selected ones of microstructures in a given set to heat while not exposing other microstructures of the given set to heat.

19. A substrate as claimed in claim 11, wherein each microstructure in said pairs of microstructures has a microstructure heater, said microstructure heater being part of a heater resistor used for heating said functional resistor.

20. A substrate as claimed in claim 19, wherein said microstructure heater in a hotter microstructure in a given set is partitioned into at least two portions that can be heated separately, to reduce peak power dissipation within said hotter microstructure.

21. A substrate as claimed in claim 19, wherein a given set has a plurality of said microstructure heaters connected together to receive heating signals to dissipate heat in selected ones of microstructures while not dissipating heat in other microstructures of the given set from said heating signals.

22. A substrate comprising a plurality of thermally isolated microstructures each housing at least part of a thermally-trimmable resistor, said thermally-trimmable resistor having at least a functional resistor, said thermally isolated microstructures being arranged in sets of pairs of facing microstructures for heat-sharing, said microstructures arranged within a given set to have a smaller number of microstructures exposed to less heat from its neighbors compared to other microstructures in the given set, than microstructures exposed to more heat from its neighbors compared to other microstructures in the given set during a trimming procedure, a level of heat being a result of a spatial relationship and a number of neighboring microstructures for a same resistor from whom heat is shared, a diagonal neighbor providing less heat than a facing or side neighbor.

* * * * *